US008857106B2

(12) United States Patent
Colson

(10) Patent No.: US 8,857,106 B2
(45) Date of Patent: Oct. 14, 2014

(54) SHUTTER WITH FIELD SERVICEABLE LOUVERS

(75) Inventor: Wendell B. Colson, Weston, MA (US)

(73) Assignee: Hunter Douglas Inc., Pearl River, NY (US)

( * ) Notice: Subject to any disclaimer, the term of this patent is extended or adjusted under 35 U.S.C. 154(b) by 0 days.

(21) Appl. No.: 13/465,114

(22) Filed: May 7, 2012

(65) Prior Publication Data

US 2013/0118082 A1 May 16, 2013

Related U.S. Application Data

(60) Provisional application No. 61/483,943, filed on May 9, 2011.

(51) Int. Cl.
*E06B 7/08* (2006.01)
*E06B 7/096* (2006.01)

(52) U.S. Cl.
CPC ..... *E06B 7/096* (2013.01)
USPC ..... 49/403; 49/82.1; 49/74.1

(58) Field of Classification Search
USPC ..... 49/74.1, 80.1, 77.1, 82.1, 403
See application file for complete search history.

(56) References Cited

U.S. PATENT DOCUMENTS 390,392 A * 10/1888 Niss, Jr. ..... 160/175
702,148 A * 6/1902 Nettleton ..... 49/403
3,685,205 A * 8/1972 Requena ..... 49/64
5,029,413 A * 7/1991 Jovanovic ..... 49/82.1
5,052,150 A * 10/1991 Chen ..... 49/82.1
5,216,837 A * 6/1993 Cleaver et al. ..... 49/82.1
5,339,591 A * 8/1994 Underdahl ..... 52/473
5,467,556 A * 11/1995 Lin ..... 49/82.1
5,469,658 A * 11/1995 Digianni et al. ..... 49/82.1
5,887,386 A * 3/1999 Alexanian et al. ..... 49/403
5,921,028 A * 7/1999 Marocco ..... 49/403
6,094,864 A * 8/2000 Hsu ..... 49/82.1
6,314,680 B1 * 11/2001 Buckwalter et al. ..... 49/82.1
6,401,391 B2 * 6/2002 Gabriele ..... 49/87.1
6,401,395 B2 * 6/2002 Gabriele ..... 49/403
6,453,972 B1 * 9/2002 Sher et al. ..... 160/133
6,499,255 B1 * 12/2002 Givoni ..... 49/82.1
6,536,162 B2 * 3/2003 LaMay ..... 49/403
6,568,131 B1 * 5/2003 Milano, Jr. ..... 49/82.1
6,701,669 B1 * 3/2004 Yorgason ..... 49/82.1
6,782,938 B2 * 8/2004 Colson et al. ..... 160/121.1
6,848,213 B1 * 2/2005 Swapp ..... 49/82.1
6,901,701 B2 * 6/2005 Lee ..... 49/82.1
6,901,988 B2 * 6/2005 Colson et al. ..... 160/168.1 R (Continued)

*Primary Examiner* — Katherine Mitchell
*Assistant Examiner* — Shiref Mekhaeil
(74) *Attorney, Agent, or Firm* — Day Pitney LLP

(57) ABSTRACT

A shutter is disclosed having plural substantially similar louvers, including a first louver having a first louver end, with a first end cap molded with a first gear projecting away from the louver. The louver includes a second louver end, widthwise opposing the first end, having a retractable boss projecting away from the louver. A frame includes a first stile and a widthwise opposing second stile, a top rail and a height-wise opposing bottom rail, defining a shutter fenestration. The first stile has a first widthwise inner-facing wall, which has plural height-wise spaced gear openings, each releasably receiving one gear and having a diameter that is at least as large as an addendum circle for the gear. The second stile has a second widthwise inner-facing wall, which has plural height-wise spaced boss openings for releasably receiving one retractable boss. Accordingly, the louvers are removably disposed in the shutter fenestration.

25 Claims, 12 Drawing Sheets

(56) References Cited

U.S. PATENT DOCUMENTS

| | | | | |
|---|---|---|---|---|
| 7,178,291 | B2 * | 2/2007 | Vasquez | 49/82.1 |
| 7,328,533 | B1 * | 2/2008 | Coleman | 49/74.1 |
| 7,353,636 | B1 * | 4/2008 | Anderson et al. | 49/82.1 |
| 7,363,748 | B2 * | 4/2008 | Gabriele | 49/403 |
| 7,377,074 | B2 * | 5/2008 | Marocco | 49/87.1 |
| 7,389,609 | B2 * | 6/2008 | Yorgason | 49/82.1 |
| 7,434,353 | B2 | 10/2008 | Nien et al. | |
| 7,574,827 | B2 * | 8/2009 | Huang et al. | 49/90.1 |
| 7,921,602 | B2 * | 4/2011 | Ohanesian | 49/403 |
| 8,161,682 | B2 * | 4/2012 | Marocco | 49/87.1 |
| 8,474,187 | B2 * | 7/2013 | Marocco | 49/403 |
| 2002/0148165 | A1 * | 10/2002 | LaMay | 49/403 |
| 2004/0031233 | A1 * | 2/2004 | Cope et al. | 52/769 |
| 2005/0076569 | A1 * | 4/2005 | Griffiths et al. | 49/82.1 |
| 2005/0257429 | A1 * | 11/2005 | Yorgason | 49/82.1 |
| 2006/0070300 | A1 * | 4/2006 | Gabriele | 49/403 |
| 2006/0248801 | A1 * | 11/2006 | Marocco | 49/74.1 |
| 2006/0272214 | A1 * | 12/2006 | Simonelli et al. | 49/92.1 |
| 2009/0120000 | A1 * | 5/2009 | Marocco | 49/74.1 |
| 2012/0042570 | A1 * | 2/2012 | Marocco | 49/82.1 |

* cited by examiner

SHUTTER WITH FIELD SERVICEABLE LOUVERS

CROSS-REFERENCE TO RELATED APPLICATIONS

This Application claims priority to U.S. Provisional Patent Application No. 61/483,943 filed May 9, 2011, the entire disclosure of which is incorporated herein by reference.

BACKGROUND OF THE DISCLOSED EMBODIMENTS

1. Field of the Disclosed Embodiments

The disclosed embodiments relate to shutters.

2. Description of the Related Art

Known shutters have several distinct disadvantages. One disadvantage to known shutters is assuring that all louvers in the shutter have a proper pitch alignment. Known configurations often connect gear members to the ends of the louvers by set screws, rivets, or other point connections. These connections require significant adjustment during assembly and become loose or break over time. As a result, louvers can slip relative to each other and to a drive motor, resulting in an unsightly display. Another disadvantage is related to shutter assembly and service. There is little opportunity to install and/or service shutters in the field. This is because typically, to add or remove shutter louvers, one must remove the shutter framing to expose and manipulate the connections between the louvers and the shutter. Accordingly, shutter installation and service assembly is time consuming and very costly to the customer.

BRIEF SUMMARY OF THE DISCLOSED EMBODIMENTS

In view of the known shutter challenges, a shutter is disclosed having plural substantially similar louvers, including a first louver having a first louver end, with a first end cap molded with a first gear projecting away from the louver. The louver includes a second louver end, widthwise opposing the first end, having a retractable boss projecting away from the louver. A frame includes a first stile and a widthwise opposing second stile, a top rail and a height-wise opposing bottom rail, defining a shutter fenestration. The first stile has a first widthwise inner-facing wall, which has plural height-wise spaced gear openings, each releasably receiving one gear and having a diameter that is at least as large as an addendum circle for the gear. The second stile has a second widthwise inner-facing wall, which has plural height-wise spaced boss openings, each releasably receiving one retractable boss. Accordingly, the louvers are removably disposed in the shutter fenestration.

BRIEF DESCRIPTION OF THE FIGURES

Certain embodiments of the invention will be described through the use of the accompanying drawings, which are not to be considered as limiting, and in which.

DETAILED DESCRIPTION OF THE DISCLOSED EMBODIMENTS

Figure 1:
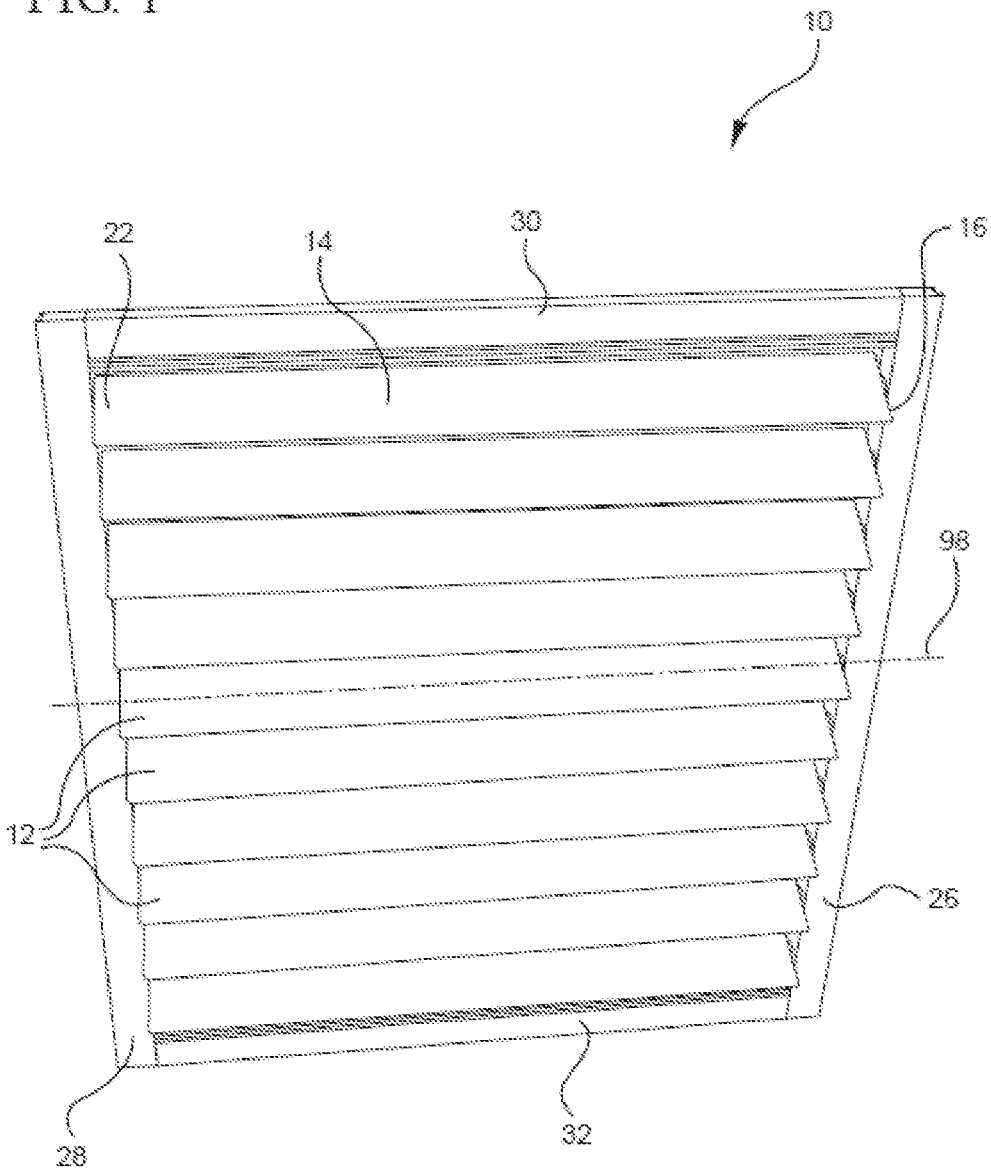
FIG. 1 is a front elevational view of the shutter with the louvers oriented downwardly.
Figure 2:
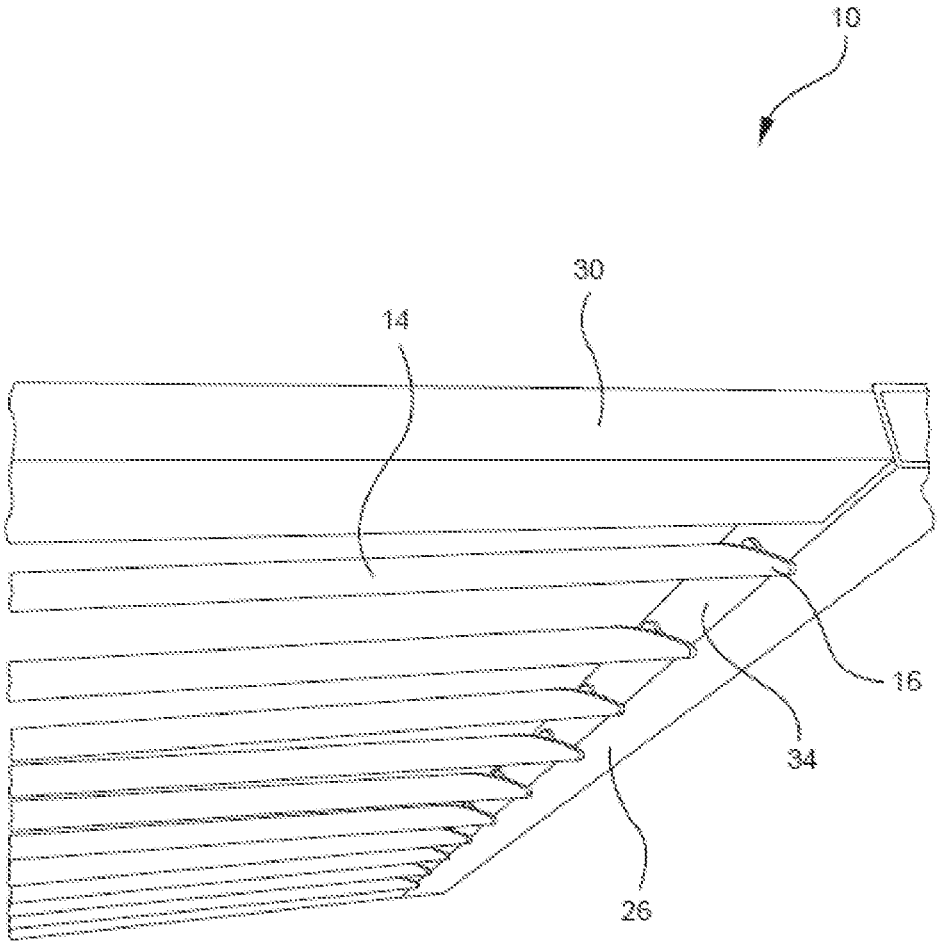
FIG. 2 is an isometric view of the shutter with the louvers oriented upwardly.
Figure 3:
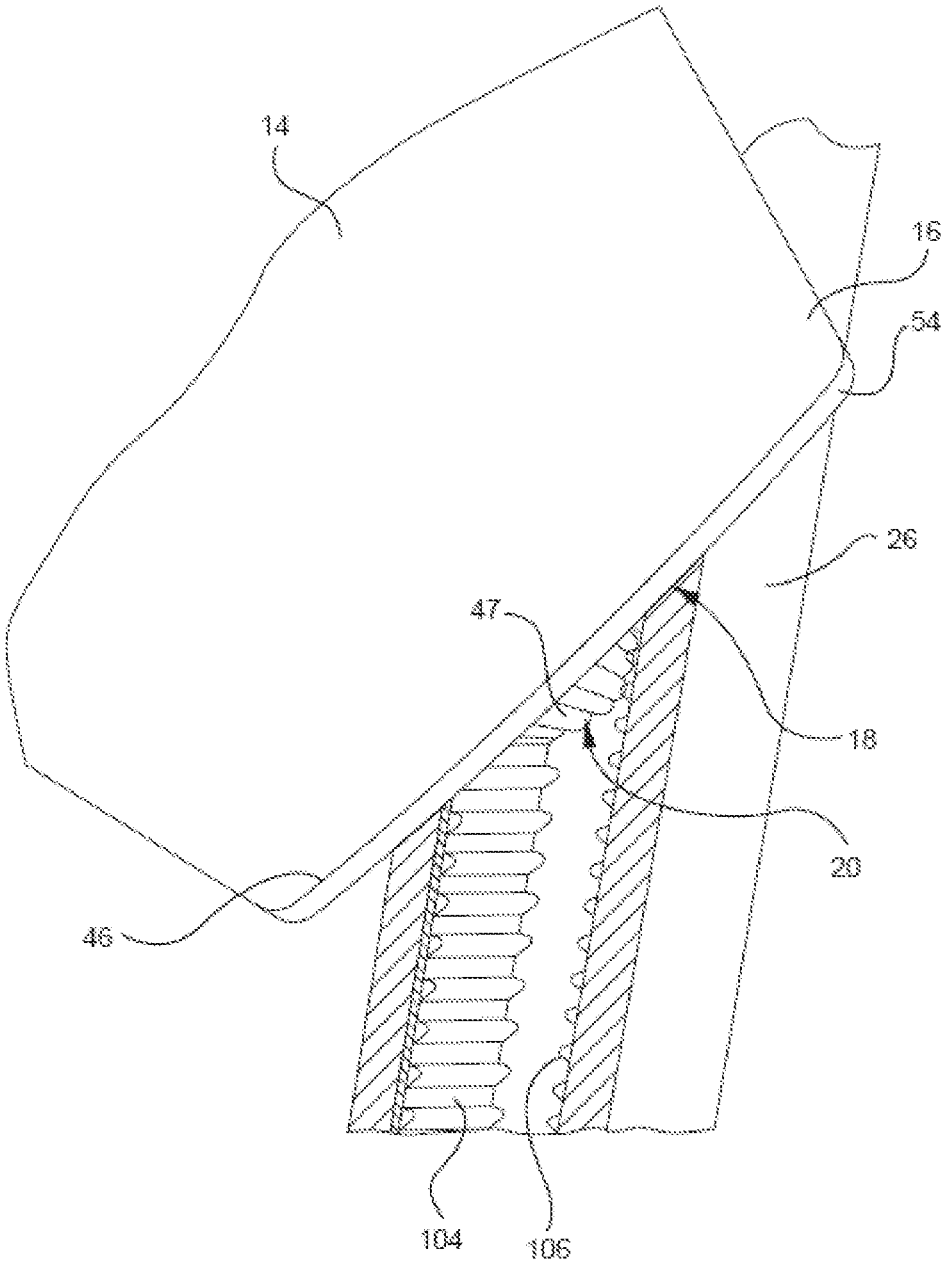
FIG. 3 is an isometric and partial cross-sectional view of a portion of the shutter, illustrating the pinion gear for a louver simultaneously engaging first and second rack gears in the first stile.
Figure 4:
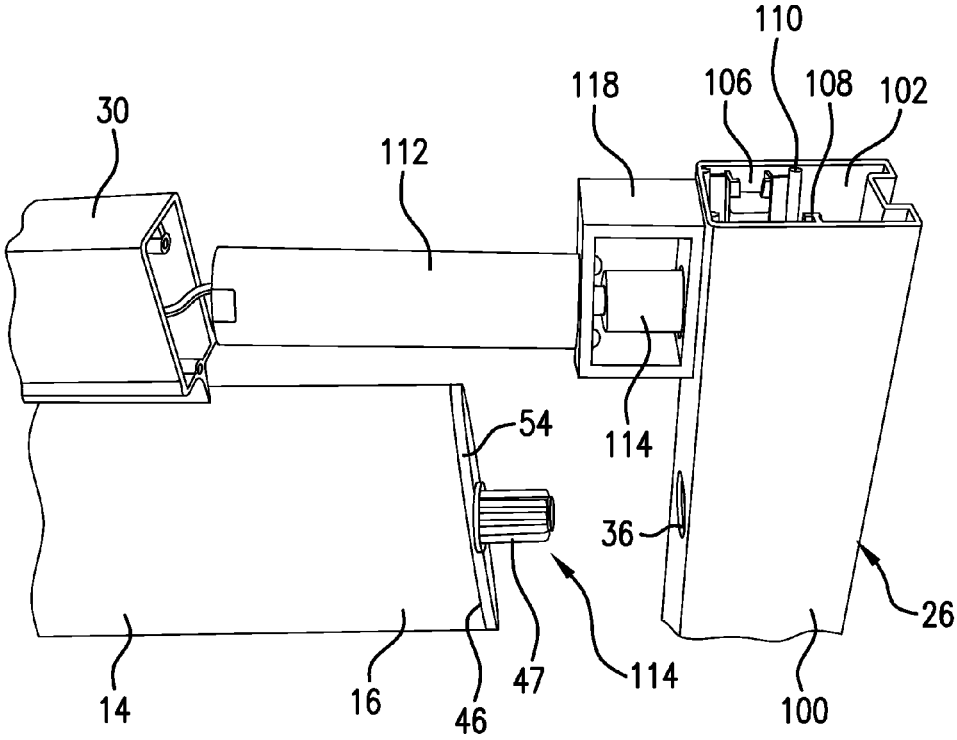
FIG. 4 is an exploded view of a portion of the shutter, illustrating the first stile, the motor mount, the motor which simultaneously drives the first and second rack gears in the first stile, the top rail and a louver.

A shutter 10 is illustrated in FIG. 1 which includes plural substantially similar louvers 12. As illustrated in FIGS. 2 through 4, the plural louvers 12 include a first louver 14 having a first louver end 16. The first louver end 16 includes a first end cap 18 molded with a first gear 20 projecting away from the louver 16. An illustration of the end cap 18 and gear 20 is further provided in FIGS. 5, 6A and 6B and will be discussed in greater detail, below.

As indicated above, the prior art tended to utilize gears which were not molded with the end cap. Instead, gears were connected to end caps via, for example, screws. The connection could wear over time, resulting in slippage of the louvers in the shutter relative to each other and to the driving motor. The unitary molded end cap 18 with the gear 20, disclosed herein, overcomes such challenges.

Figure 9:
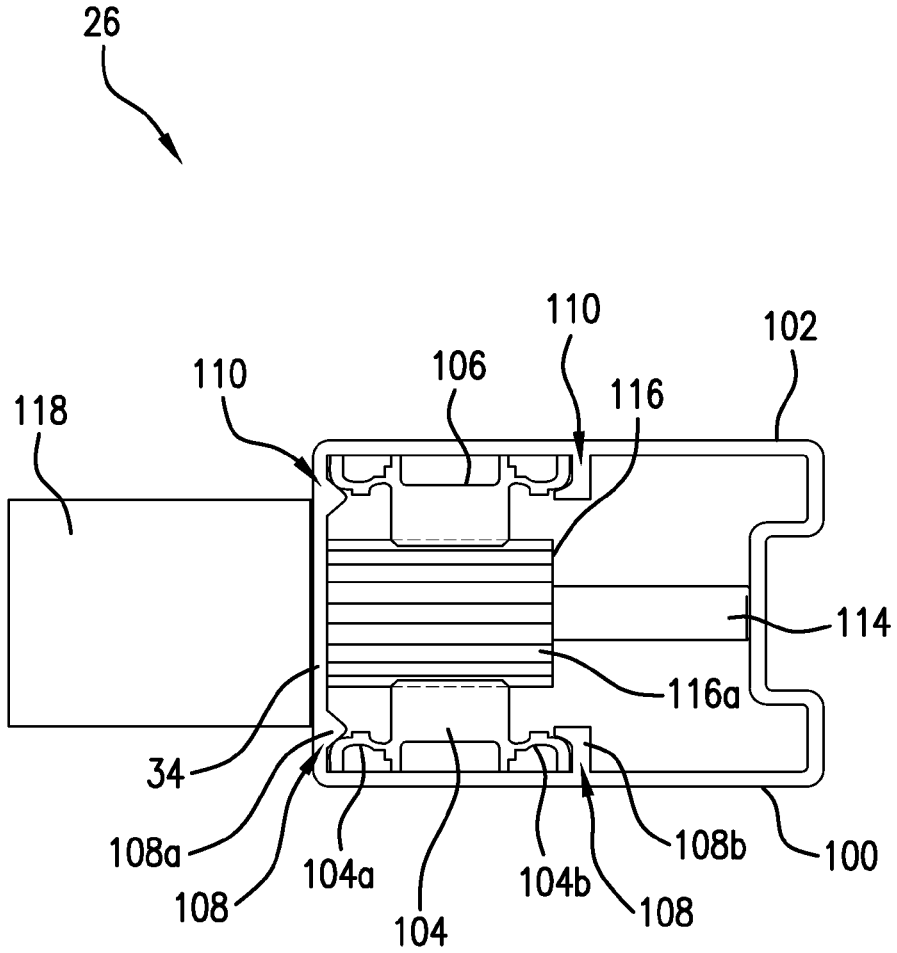
FIG. 9 is a cross sectional view of a first stile utilized in the shutter, exposing first and second rack gear members in respective first and second tracks in the first stile and a portion of the motor utilized for simultaneous driving the gears.

The louver also includes a second louver end 22 as illustrated in FIGS. 1 and 9, widthwise opposing the first louver end 16. The second louver end 22 includes a retractable boss 24 projecting away from the louver 14. The benefits of the retractable boss 24 will be addressed below.

A frame is provided, as illustrated in FIGS. 1 through 4 and 7, which includes a first stile 26 and a widthwise opposing second stile 28, a top rail 30 and a height-wise opposing bottom rail 32. When referenced herein, widthwise means widthwise relative to the shutter 10, that is, between first stile 26 and second stiles 28. Similarly, height-wise means height-wise relative to the shutter 10, that is, between top 30 and bottom rails 32.

The space between the opposing stiles 26, 28 and rails 30, 32 defines a shutter fenestration. The shutter fenestration, as will be appreciated from reading this disclosure, is an opening in which the louvers 12 can be field serviced, that is, installed and removed, without having to remove the shutter frame from the building structure.

Figure 5:
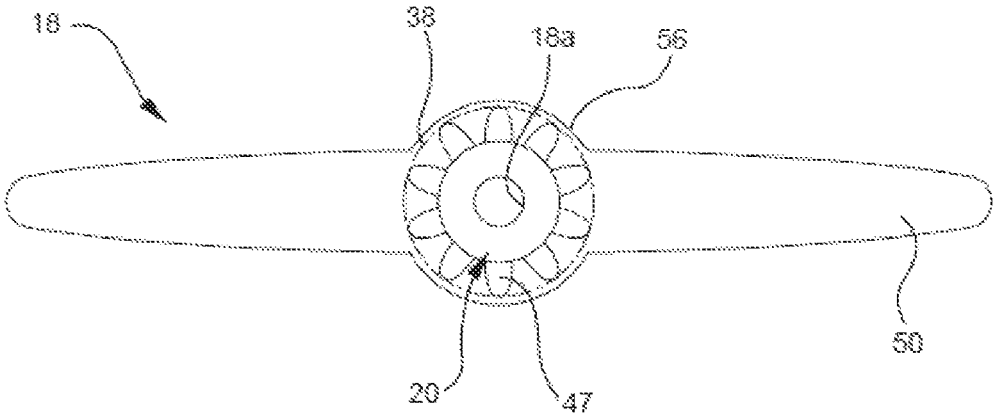
FIG. 5 is a top elevational view of an end cap utilized in the shutter, illustrating the pinion gear relative to the end cap.
Figure 7:
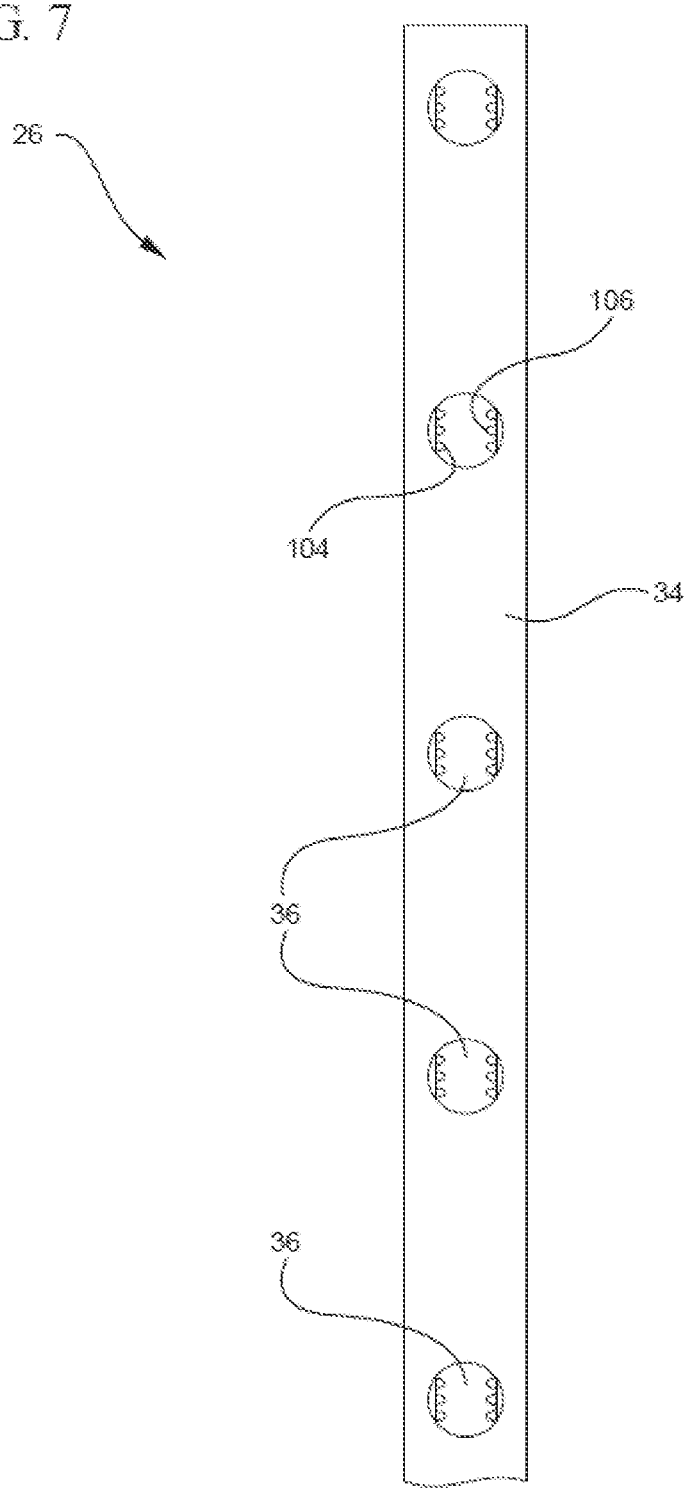
FIG. 7 is a front elevational view of a stile utilized in the shutter, illustrating the openings in the stile for receiving the pinion gear and illustrating teeth of the rack gear disposed therein.

The first stile 26 has a first widthwise inner-facing wall 34, which has plural height-wise spaced gear openings 36, as illustrated in FIG. 7. Each gear opening of the plural openings 36 releasably receives one gear 20 from a respective louver 14 and has diameter that is at least as large as an addendum circle 38, that is, the outermost diameter, for the gear 20, which is illustrated in FIG. 5. Having a diameter for the gear opening 36 in the first stile 26 which is at least as large as the addendum circle 38 enables field servicing the louvers 12, that is, installing and removing the louvers 12, without having to remove the shutter frame from the building structure.

Figure 8:
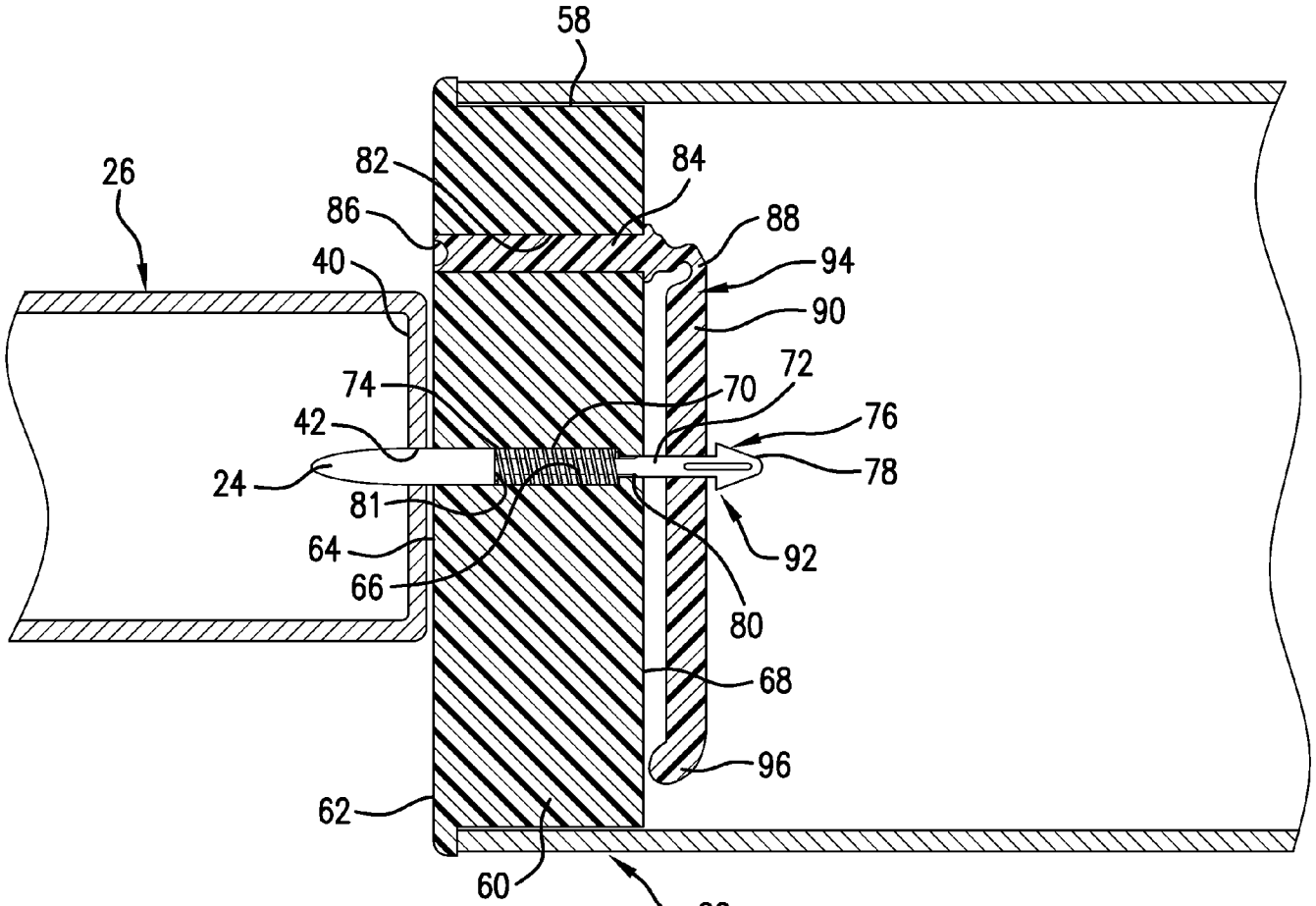
FIG. 8 is partial cross sectional view of a louver with a second end cap having a push pin for removably connecting the louver to a second stile.

On the other hand, the second stile 28 has a second widthwise inner-facing wall 40 as illustrated in FIG. 8. The second inner-facing wall 40 has a plural height-wise spaced boss openings, including illustrated first opening 42. The boss openings 42 correspond with, and are centered in the widthwise direction with, the gear openings 36 for proper alignment of the plural louvers 12. The openings 42 releasably receive one respective retractable boss 24.

Figure 10:
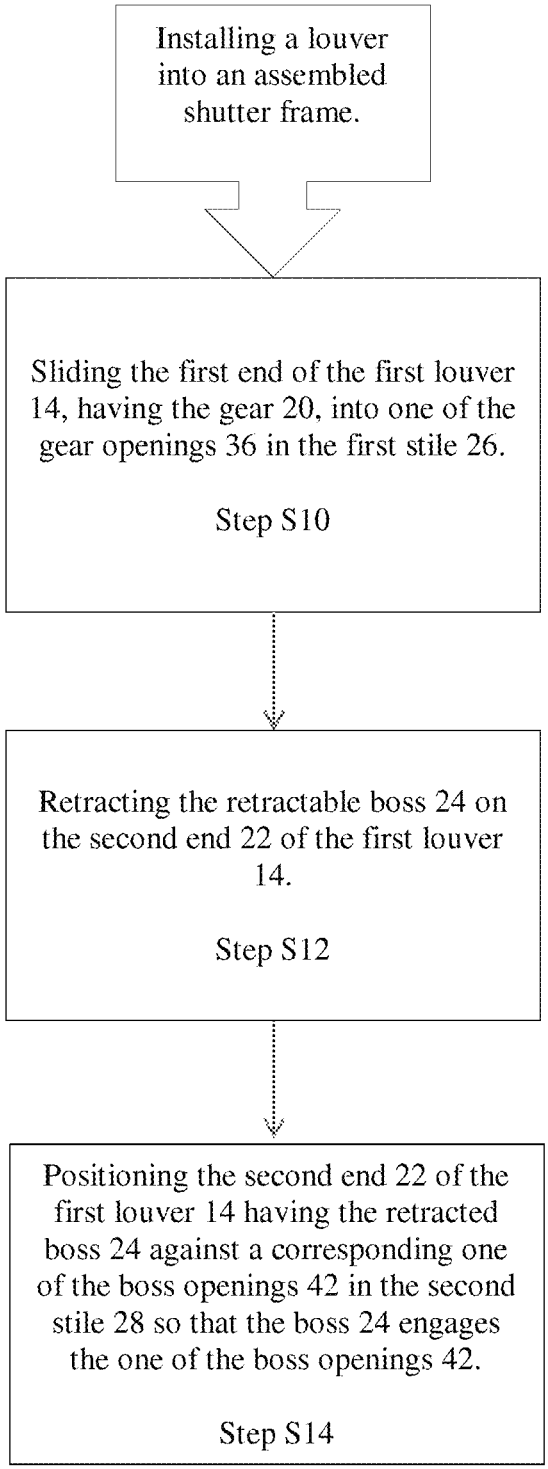
FIG. 10 is a flow chart, illustrating the process of installing a louver into an assembled shutter frame.

As a result of the retractable boss 24 on the second stile 28 and the size of the gear openings 36 in the first stile 26, the louvers 12 are capable of being installed into the shutter fenestration with a few steps. For example, as illustrated in FIG. 10, a step S10 includes sliding the first end of the first louver 14, having the gear 20, into one of the gear openings 36 in the first stile 26. A second step S12 includes retracting the retractable boss 24 on the second end 22 of the first louver 14. A third step S14 includes positioning the second end 22 of the first louver 14 having the retracted boss 24 against a corresponding one of the boss openings 42 in the second stile 28 so that the boss 24 engages one of the boss openings 42.

Figure 11:
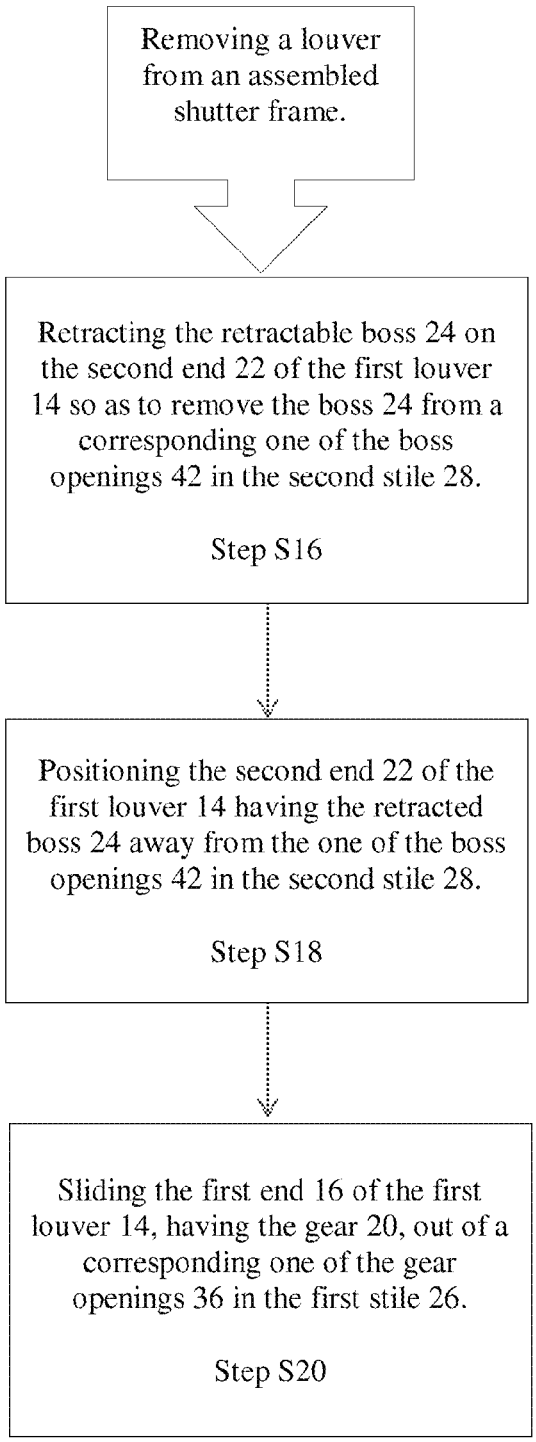
FIGS. 11 and 12 are flow charts, illustrating the process of removing a louver from an assembled shutter frame.

Removal of the louvers would be the reverse order of assembly. That is, as illustrated in FIG. 11, removal would require a first step S16 of retracting the retractable boss 24 on the second end 22 of the first louver 14 so as to remove the boss 24 from a corresponding one of the boss openings 42 in the second stile 28. A second step S18 is positioning the second end 22 of the first louver 14 having the retracted boss 24 away from the one of the boss openings 42 in the second stile 28. A third step S20 is sliding the first end 16 of the first louver 14, having the gear 20, out of a corresponding one of the gear openings 36 in the first stile 26.

As can be appreciated from the above disclosure, installing and removing louvers 12 from a shutter fenestration, that is, from an assembled shutter frame, is dramatically simpler than with known shutters. Field servicing louvers is now possible, which is beneficial for easy cleaning or replacement of the louvers as necessary. It is foreseeable that one could seek to replace an entire set of louvers for purposes of updating an appearance. Such a modification would be significantly more difficult if removal of the frame were required, as is the industry norm.

Focusing now on more specific aspects of the shutter design, as illustrated in FIGS. 2, 4, and 5, the first louver 16 has an edge profile 46, and the gear addendum circle diameter 38 is larger than the edge profile 46. Having a larger gear enables having larger gear teeth 47, providing greater force transmission to the gear from the driving gear disposed within the first stile 26, which will be disclosed in greater detail, below. The larger addendum circle diameter translates to the larger size of the gear openings 36, as illustrated in FIG. 7.

Figure 6A:
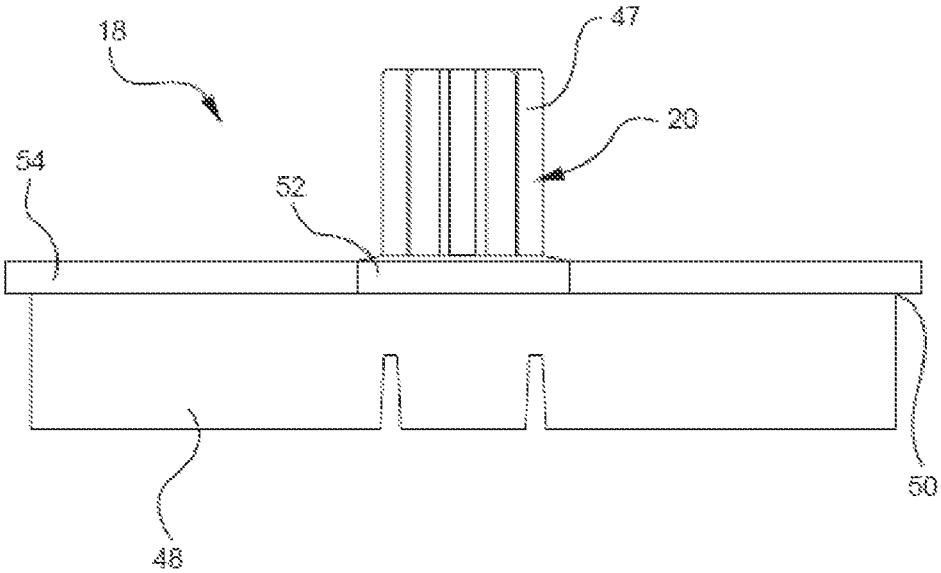
FIG. 6A is a side elevational view of an end cap utilized in the shutter, illustrating the pinion gear, cap flange, and a plug connector for connecting the cap to the shutter.
Figure 6B:
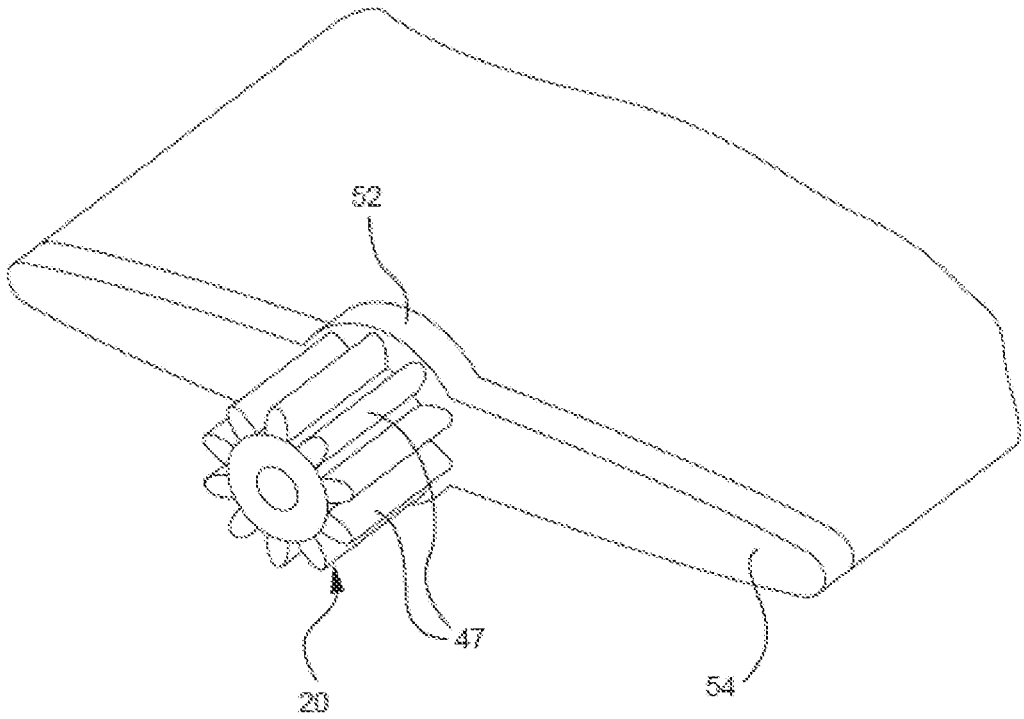
FIG. 6B is an isometric view of an end cap utilized in the shutter, inserted into a louver, illustrating the pinion gear, cap flange, and a plug connector for connecting the cap to the shutter.

The first louver end 16 has a first internal surface profile (not illustrated) and, as illustrated in FIGS. 6A and 6B, the first end cap 18 includes a first louver fitting or first plug connector 48 having a substantially matching outer surface profile as the first louver end 16 so that the plug connector 48 and the first louver end 16 have a plug and socket engagement. Notches are provided at the widthwise inner end of the plug connector 48 allowing the plug connector 48 to flex into a tight relationship with the louver 14 as well as to enable flexing of the plug connector 48 should removal be required. A widthwise outer end of the plug connector 48 serves as an axial base 52 of the gear 20. It is noted that the axial direction, as referred to herein, is parallel with the shutter widthwise direction, noted above.

The end cap 18 includes a first raised edge flange 54, as illustrated in FIGS. 4 *through* 6A and 6B, extending about the widthwise outer end of the plug connector 48. The flange 54 defines a maximum insertion of the plug connector 48 into the louver 14. A first portion 56 of the flange 54 extends about the base 52 of the gear 20 and has a contour which corresponds with, and is larger than, the addendum circle 38 for the gear 20. In addition, as can be appreciated by viewing FIG. 2, the diameter of the gear openings 36 is smaller than the portion 56 of the edge flange 54 at the base 52 of the gear 20. From the relative sizing, the gear openings 36 are substantially visually blocked by the installed louvers 12. This blocking also prevents foreign matter from entering the first stile 26, which could jam the gearing operation and cause other types of damage.

Turning to the second louver end 48 of the first louver 14, as illustrated in FIG. 8, the louver 14 has a second internal surface profile (not illustrated) which is substantially similar to the first internal surface profile. The first louver 14 includes, at the second louver end 48, a second end cap 58 with a second plug connector 60 having a substantially matching outer surface profile as the first plug connector 48. In addition, the second plug connector 60 has a second raised edge flange 62 at a widthwise outer end of the second plug connector 60. The second flange 62 has a substantially same profile as the first flange 54, so that a second portion 64 of the second flange 62, which forms a base for the retractable boss 24, has a same shape of the first portion 56 of the first flange 54.

It is noted that the retractable boss 24 does not have the same diameter as the gear 20. Accordingly, the boss openings 42 in the second stile 28 are not as large as the gear openings 36 in the first stile 26. Accordingly, the second portion 64 of the second flange 62 need not be as large as the first portion 56 of the first flange 54 to prevent the infiltration of foreign matter into the second stile 28. However, the similar shape between the flanges 54, 62 in the respective end caps 18, 58, provides a visual balance to the shutter 10, as can be appreciated.

The second end cap 58 includes an axial opening 66 extending therethrough. That is, the axial opening 66 extends from the widthwise outer end 62 of the second plug connector 60 to a widthwise inner end 68 of the second plug connector 60. In addition, the retractable boss 24 is a push pin disposed in the axial opening 66 and actuated by a spring 70. The push pin 24 includes a stem 72 having a first axial end 74 which includes the push pin 24. A second axial end 76 of the stem 72 includes a stem flange 78 disposed against the widthwise inner end 68 of the second plug connector 60.

It is noted that FIG. 8, while a cross sectional view through the center of the louver 14, is only partially hatched for clarity. That is, the push pin 24, stem 72, stem flange 78 and spring 70 are illustrated in an elavational view and therefore illustrated without hatching.

As illustrated, the push pin 24 portion of the stem 72 and the stem flange 78 both have a larger diameter then the remainder of the stem 72. Such difference in diameter at the push pin 24 side of the stem 72 arises from a step in the diameter at the base 81 of the push pin. On the stem flange 78 side of the stem 72, such a difference in diameter comes from molding a larger flange 78 as compared with the rest of the stem 72. In addition, an axial end 80 of the opening 66 is narrowed, forming a neck with a diameter which is smaller than the diameter of the push pin 24 and stem flange 78 but larger than the remainder of the stem 72. Such a difference in the diameter at the opening neck 80 comes from a step in diameter at the location of the opening neck 80. From this geometry, the push pin 24 is prevented from falling out of the second end cap 58.

The two diameter steps, at the base 81 of the push pin 24 and at the opening neck 80, define opposing seats for containing the spring 70. As a result, the spring 70 is in compression when the push pin 24 is retracted. In addition, as illustrated the push pin 24 has a loose, free turning fit with the second end cap 58 of the first louver 14, and a tighter fit, though not binding with the boss opening 42 in the second stile 28. Further, the spring 70 is sized to go to full extension before the push pin 24 hits its extension limits. This means the spring 70 is loose once the push pin 24 is extended into the second stile 28, eliminating a source of turning friction which may cause the push pin 24 to turn in the second stile 28. The benefit of this fit become clear when considering that the frame can be made of aluminum, and the push pin 24 is typically made of plastic. Without this fit configuration, the push pin 24 could spin with the louver 14 against the aluminum material, and could wear out.

As illustrated, the stem flange 78 is formed as a flexible wedge anchor. To install the push pin 24 into the opening 66, the push pin 24 is pressed towards the widthwise inner end of the second plug connector 60 through the opening 66. The wedge anchor 78 will compress as it passes through the opening neck 80 and expand thereafter, locking the push pin 24 in place.

The widthwise (lateral) clearance between the end caps 18, and the stiles 26, 28 on each end are small to keep light gaps low. For example, the clearance may be about a thirty second of an inch or less. One option to retract the push pin 24 is sliding a knife or screwdriver into that clearance area and work the push pin 24 back in order to remove the louver 14. Some might consider this a challenge.

FIG. 8 includes an alternate arrangement for retracting the push pin 24. In this arrangement, the second end cap 58 includes an additional axial opening 82 extending from the widthwise outer end 62 of the second plug connector 60 to the widthwise inner end 68 of the second plug connector 60. A release button stem 84 extends through the opening 82. The release button stem 84 includes a release button 86 at a widthwise outer end of the second end cap 58 and a living hinge 88 at the widthwise inner end of the second end cap 58. The release button 86 is flush or inset in the second end cap 58 so as not to be accidentally actuated. Rather, it can be actuated with, for example, the tip of a screwdriver.

Further, a pin leaver 90 extends along the widthwise inner end 68 of the second plug connector 60. The pin leaver 90 is connected to an intermediate point 92 along its length to the push pin stem 72. The connection is such that the pin leaver 90 is between the stem flange 78 for the push pin 24 and the widthwise inner end 68 of the second plug connector 60. It can be appreciated that the push pin stem 72 is long enough in this embodiment to accommodate the space required for positioning the stem flange 78 for the push pin 72 away from the widthwise inner end 68 of the second plug connector without inadvertently retracting the push pin 24.

In addition, the pin lever 90 has a first end 94 which is connected to the living hinge 88. As a result of this configuration, a second end of the pin lever 96 becomes a lever point for retracting the push pin 24 upon depressing the release button 86. From this, the louvers 12 are removably disposed in the shutter fenestration.

Figure 12:
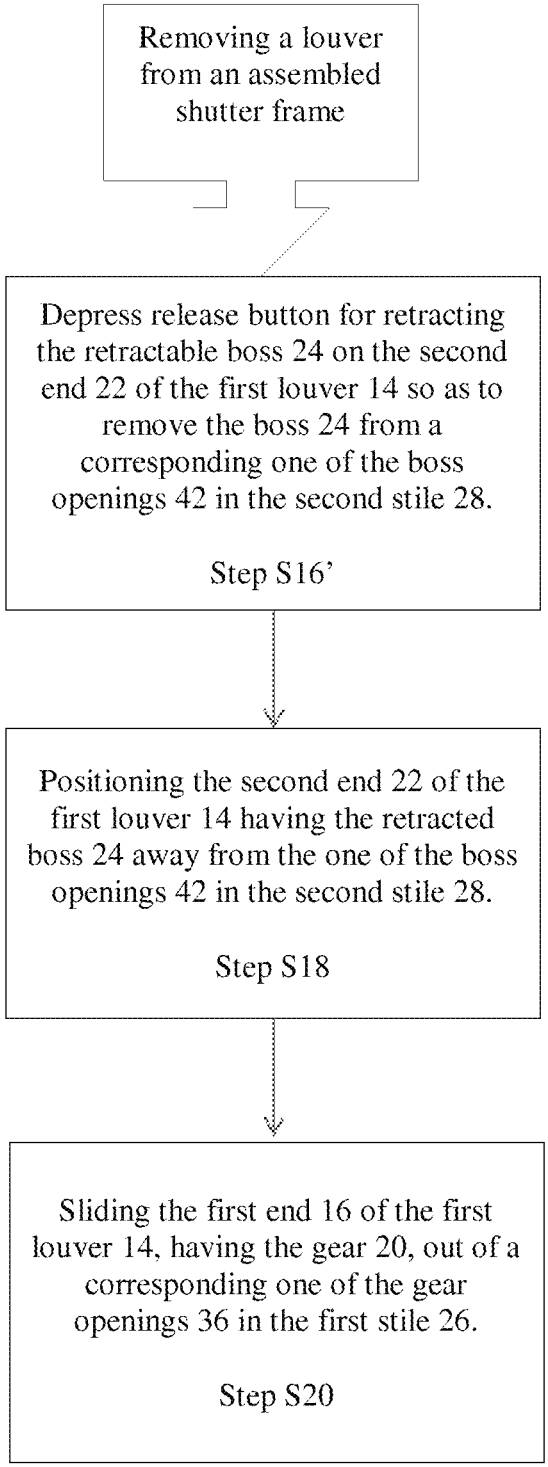

In other words, due to the application of the release button 86 on the second end cap 58, as illustrated in FIG. 12, one need only depress the release button 86 to perform above noted step S16 of retracting the retractable boss 24 on the second end 22 of the first louver 14 so as to remove the boss 24 from a corresponding one of the boss openings 42 in the second stile 28. Thereafter, the above noted two steps for removing the louver 14 are carried out. That is step S18 remains positioning the second end 22 of the first louver 14 having the retracted boss 24 away from the one of the boss openings 42 in the second stile 28. Further, step S20 remains sliding the first end 16 of the first louver 14, having the gear 20, out of the corresponding one of the gear openings 36 in the first stile 26.

According to another alternative arrangement, illustrated only in phantom lines in FIG. 1, one or more of the louvers can have a rod 98 extending therethrough which is fixedly connected to the first and second stiles 26, 28. This would provide lateral support to the frame. The one or more louvers having the rod 98 would be pivotable about the rod 98 and would also be without a retractable boss 24, though it would have a geared end cap which enters the first stile 26 and is driven with the rest of the louvers 12. Such an end cap 18 would have an axial drill-hole opening 18*a* (FIG. 5), creating a pass-through for the rod 98. This configuration would be beneficial when, for example, the height of the shutter 10 is such that there is a concern that the stiles 26, 28 will bow inwardly or outwardly, the latter of which could result in the louvers 12 falling out of the frame. The rod 98 can be utilized instead of traditional methods of including one or more intermediate rails, which block viewing area and can be unattractive.

Further disclosure is now provided for the gearing configuration and operation, and the structure for facilitating this configuration and operation, of the shutter 10 illustrated in FIG. 1. With additional reference to FIGS. 3 through 7 and 9, the gear 20 in the end cap 18 is a straight pinion gear having plural teeth 47 equally spaced about the pinion circumference. Further, the first stile 26 is a hollowed rectangular extrusion, including a first front-facing wall 100 and a first rear-facing wall 102 which are parallel to each other and perpendicular to the first inner-facing wall 34. A first rack gear 104 is slidingly positioned against one of the first front-facing wall 100 and the first rear-racing wall 102 and is capable of translating towards and away from the top and bottom rails 30, 32. Such translating motion, with the pinion gears meshed with the first rack gear 104, will simultaneously drive the louvers to open and close. It is to be appreciated that the inner-facing wall 34 in FIG. 3 is drawn in partial cross section, exposing the rack gear 104 therein.

For additional gear stability and force transmissibility, a second rack gear 106 is illustrated in FIGS. 3, 7 and 9. The second rack gear 106 is disposed within the first stile 26 against the other of the first front-facing wall 100 and the first rear-facing wall 102. The second rack gear 106 is also capable of translating towards and away from the top and a bottom rails 30, 32. With the provided configuration, when the first rack gear 104 translates towards the top rail 30, the second rack gear 106 translates towards the bottom rail 38, and vice versa. Again, with the pinion gears meshed between the first and second rack gears 104, 106, each of the plural louvers 12 is simultaneously driven to open and close.

As indicated, the addition of the second rack gear 106 to the first rack gear 104 provides a more stable gear meshing and force transmissibility between the rack gears 104, 106 and each pinion gear 20. The force of turning the pinion gear 20 is disbursed between the two rack gears 104, 106, minimizing stress in either. Further, by flanking the pinion gear 20 with two rack gears 104, 106, the possibility of slippage during operation of the shutter 10 is decreased.

The first stile 26 includes a first track 108, extruded with the first stile 26, for receiving the first rack gear 104 and slidably positioning the first rack gear 104 against the one of the first front-facing wall 100 and the first rear-facing wall 102. In addition, a second track 110, extruded with the first stile 26, is provided for receiving the second rack gear 106 and slidably positioning the second rack gear 106 against the other of the first front-facing wall 100 and the first rear-facing wall 102. This configuration keeps the rack gears 104, 106 in place relative to the first stile 24, as illustrated in FIG. 7, to enable reliable insertion of the pinion gear 20 in each of the louvers 12.

The rack gears 104, 106 have extension feet on either side, for example, 104*a*, 104*b*, which slide into respective "L" brackets, for example, 108*a*, 108*b*, forming the track. Note in the illustration, part of bracket 108*a* is the front wall 34 of the stile 26. That is, the rack gears 104, 106 are slid into place from above or below the first stile 26 when initially assembling the frame. In addition, as can be appreciated, the rack gears 104, 106 are long enough to span the distance between each of the gear openings 36 and to reach the motor, discussed below. Accordingly, the tracks 108, 110 are similarly as long.

With the above disclosure related to the pinion gear 20 and the first and second rack gears 104, 106, the spacing between gear openings 36 in the first stile 26 will be addressed. This height-wise spacing is a constant multiple of the pitch of the pinion gear teeth 47. As a result of this substantially constant spacing, along with the unitary formation of the gear 20 with the first end cap 18, each of the plural louvers 12 will have a substantially same pitch relative to the shutter 10 when installed and operated. This is a significant improvement to the configuration where, for example, the gear 20 is not integral with the end cap 18 but is screwed to the end cap. In such a configuration, a relatively extensive amount of adjustments are required to properly align the louvers 12.

In order to drive the rack gears 104, 106, which in turn drive each pinion gear 20, as disclosed in FIGS. 4 and 9, one of the top rail 30 and the bottom rail 32 is a rectangular extrusion, and a motor 112 is disposed therein. The motor 112 includes a drive shaft 114 extending through the first inner-facing wall 34 of the first stile 26. In addition, a drive gear 116 is disposed within the first stile 26, connected to the drive shaft 114. Teeth 116*a* of the drive gear 116 are meshed with the rack gears 104, 106, for simultaneously driving the rack gears 104, 106, thereby simultaneously controlling the pitch of each of the louvers 12 relative to the shutter 10. In addition, a motor support housing 118 is disposed within the one of the top rail 30 and the bottom rail 32 in which the motor is disposed. The motor housing 118 is connected to the first stile 26 for supporting the motor 112.

According to other aspects of the disclosed embodiment not expressly mentioned above, as illustrated in FIG. 1, a height of the louvers 12 is such that the height of the shutter fenestration is substantially covered when the shutter 10 is closed. Further, the shutter frame can be entirely formed from extruded metal which, as indicated, can be aluminum. In addition, each of the gear and boss openings 36, 42 can be drilled out from the first and second extruded metal stiles 26, 28. Yet furthermore, each of the louvers 12 can be aluminum metal while each end cap 18, 58 and the rack gears 104, 106 can be substantially molded plastic. In addition, to open and close the shutter 10, the motor 112 can be controlled by a remote or by a wall switch.

The present disclosed embodiments elements may be configured in other specific forms without departing from the spirit or essential characteristics identified herein. The described embodiments are in all respects only as illustrative and not as restrictive. The scope of the embodiments are, therefore, indicated by the appended claims and their combination in whole or in part rather than by the foregoing description. All changes that come within the meaning and range of equivalency of the claims are to be embraced within their scope.

I claim:

1. A shutter comprising:

plural substantially similar louvers, including a first louver having a first louver end, with a first end cap molded with a first gear projecting away from the louver;

a second louver end, widthwise opposing the first end, having a retractable boss projecting away from the louver;

a frame including a first stile and a widthwise opposing second stile, a top rail and a height-wise opposing bottom rail, defining a shutter fenestration;

the first stile has a first widthwise inner-facing wall, which has plural height-wise spaced gear openings, each releasably receiving one gear and having a diameter that is at least as large as an addendum circle for the gear;

the second stile has a second widthwise inner-facing wall, which has plural height-wise spaced boss openings, each releasably receiving one retractable boss, the retractable boss having a first axial end engaging one of the boss openings in the second stile, and a second axial end engaging a portion of a pin lever disposed within the louver, the retractable boss being retractable out of the second stile and into the louver by pushing the lever into the louver;

whereby, the louvers are removably disposed in the shutter fenestration.

2. The shutter of claim 1, wherein the first louver end has an edge profile whose planar surface is of a substantially elliptical shape defined by a length along the major axis of the elliptical shape and a width along the minor axis of the elliptical shape, and the gear addendum circle diameter is larger than the width of the edge profile.

3. The shutter of claim 2, wherein:

the first louver end has a first internal surface profile and the first end cap includes a first plug connector having a substantially matching outer surface profile as the first louver end, where a widthwise outer end of the plug connector is an axial base of the gear;

the end cap includes a first raised edge flange extending about the widthwise outer end of the plug connector defining a maximum insertion of the plug connector into the louver;

a first portion of the flange extends around the base of the gear and has a contour whose shape corresponds with, and whose diameter is larger than that of, the addendum circle for the gear; and the diameter of the gear openings is smaller than the portion of the edge flange at the base of the gear; whereby the gear openings are substantially visually blocked by the installed louvers.

4. The shutter of claim 3, wherein:

the second louver end of the first louver has a second internal surface profile which is substantially similar to the first internal surface profile, and the first louver includes, at the second louver end, a second end cap, which includes a second plug connector having a substantially matching outer surface profile as the first plug connector;

the second plug connector has a second raised edge flange at a widthwise outer end of the second plug connector, having a substantially same profile as the first flange, so that a second portion of the second flange, which forms a base for the retractable boss, has a same shape of the first portion of the first flange.

5. The shutter of claim 4, wherein:

the second end cap includes an axial opening extending from the widthwise outer end of the second plug connector to a widthwise inner end of the second plug connector;

the retractable boss is a push pin, disposed in the axial opening, actuated by a spring, the push pin includes a stem having the first axial end which includes the push pin and the second axial end which includes a stem flange disposed against the widthwise inner end of the second plug connector;

the push pin portion of the stem and the stem flange both have a larger diameter then the remainder of the stem, and an axially intermediate portion of the opening has a diameter which is smaller than the diameter of the push pin and stem flange and larger than the remainder of the stem, whereby the push pin is prevented from falling out of the second end cap; and the spring is sized to seat between, and be held in place by, the push pin and the axially intermediate portion of the opening, whereby the spring is in compression when the push pin is retracted.

6. The shutter of claim 5, wherein the second end cap includes:

an additional axial opening extending from the widthwise outer end of the second plug connector to the widthwise inner end of the second plug connector, and a release button stem extending through the opening;

the release button stem including a release button at a widthwise outer end of the second end cap and a living hinge at the widthwise inner end of the second end cap;

the pin lever extending along the widthwise inner end of the second plug connector, connected at an intermediate point along its length to the push pin stem, between the stem flange and the widthwise inner end of the second plug connector; and the pin lever having a first end connected to the living hinge, whereby a second end of the pin lever is a lever point for retracting the push pin upon depressing the release button; and whereby, the louvers is removably disposed in the shutter fenestration.

7. A method of removing the first louver from the shutter fenestration of claim 6, comprising:

depressing the release button for retracting the retractable boss on the second end of the first louver so as to remove the boss from a corresponding one of the boss openings in the second stile;

positioning the second end of the first louver having the retracted boss away from the one of the boss openings in the second stile; and sliding the first end of the first louver, having the gear, out of a corresponding one of the gear openings in the first stile.

8. The shutter of claim 1, wherein one or more of the louvers has a rod extending therethrough which is fixedly connected to the first and second stiles, for providing lateral support to the frame, the one or more louvers being pivotable about the rod and being without a retractable boss.

9. The shutter of claim 1, wherein the gear is a straight pinion gear having plural teeth equally spaced about the pinion circumference.

10. The shutter of claim 9, wherein:

the first stile is a hollowed rectangular extrusion, including a first front-facing wall and a first rear-facing wall which are parallel to each other and perpendicular to the first inner-facing wall; and the shutter includes:

a first rack gear slidingly positioned against one of the first front-facing wall and the first rear-facing wall and is capable of translating towards and away from the top and bottom rails, for simultaneously driving each pinion gear;

thereby simultaneously driving each of the plural louvers.

11. The shutter of claim 10, wherein a second rack gear is disposed within the first stile against the other of the first front-facing wall and the first rear-facing wall and is capable of translating towards and away from the top and a bottom rails, so that when the first rack gear translates towards the top rail, the second rack gear translates towards the bottom rail, and vice versa, thereby simultaneously driving each of the plural louvers.

12. The shutter of claim 11, wherein the first stile includes:

a first track, extruded with the first stile, for receiving the first rack gear and slidably positioning the first rack gear against the first front-facing wall; and a second track, extruded with the first stile, for receiving the second rack gear and slidably positioning the second rack gear against the first rear-facing wall.

13. The shutter of claim 12, wherein the height-wise spacing between adjacent gear openings in the first stile is a constant multiple of a pitch of the pinion gear teeth, whereby each of the plural louvers has a same pitch relative to the shutter.

14. The shutter of claim 11, wherein one of the top rail and the bottom rail is a rectangular extrusion and a motor is disposed therein for driving the rack gears, thereby simultaneously controlling the pitch of each of the louvers relative to the shutter.

15. The shutter of claim 14, where the motor includes a drive shaft extending through the first inner-facing wall of the first stile and a drive gear is disposed within the first stile, meshed with the rack gears, for simultaneously driving the rack gears, thereby simultaneously controlling the pitch of each of the louvers relative to the shutter.

16. The shutter of claim 14, wherein a motor support housing is disposed within the one of the top rail and the bottom rail in which the motor is disposed, and the motor housing is connected to the first stile for supporting the motor.

17. The shutter of claim 14, wherein the motor is remotely controlled.

18. The shutter of claim 14, wherein the motor is controlled by a wall switch.

19. The shutter of claim 1, wherein the frame is extruded metal.

20. The shutter of claim 1, wherein each louver is metal.

21. The shutter of claim 1, wherein each end cap is substantially molded plastic.

22. The shutter of claim 1, wherein a height of the louvers is such that the height of the fenestration is substantially covered when the shutter is closed.

23. The shutter of claim 1, wherein the width of the louvers is substantially the same as the width of the shutter fenestration.

24. A method of installing the first louver in the shutter fenestration of claim 1, comprising:

sliding the first end of the first louver, having the gear, into one of the gear openings in the first stile;

retracting the retractable boss on the second end of the first louver; and positioning the second end of the first louver having the retracted boss against a corresponding one of the boss openings in the second stile so that the boss engages the one of the boss openings.

25. A method of removing the first louver from the shutter fenestration of claim 1, comprising:

retracting the retractable boss on the second end of the first louver so as to remove the boss from a corresponding one of the boss openings in the second stile;

positioning the second end of the first louver having the retracted boss away from the one of the boss openings in the second stile; and sliding the first end of the first louver, having the gear, out of a corresponding one of the gear openings in the first stile.

* * * * *